United States Patent [19]

Marsala et al.

[11] 4,358,012

[45] Nov. 9, 1982

[54] ACCOUNTANTS AND BOOKKEEPERS CARDMARKS IN DISPENSER PACK

[76] Inventors: Charlotte Marsala, c/o George Spector 3615 Woolworth Bldg., 233 Broadway; George Spector, 3615 Woolworth Bldg., 233 Broadway, both of, New York, N.Y. 10007

[21] Appl. No.: 179,676

[22] Filed: Aug. 20, 1980

[51] Int. Cl.[3] ..... B65D 83/08; B65D 85/62

[52] U.S. Cl. ..... 206/39; 116/235; 206/449; 221/33; 221/279; 281/42

[58] Field of Search ..... 206/39, 449; 281/42; 221/307, 64, 63, 33, 279; 116/234, 235

[56] References Cited

U.S. PATENT DOCUMENTS

| | | | |
|---|---|---|---|
| 446,857 | 2/1891 | Fiske | 116/235 |
| 1,346,729 | 7/1920 | Vanderveer | 116/234 |
| 3,137,269 | 6/1964 | Sager | 281/42 |
| 3,324,823 | 6/1967 | Peters | 116/234 |
| 3,360,258 | 12/1967 | Nix | 206/449 |
| 3,953,090 | 4/1976 | Fuchs | 221/279 |
| 3,977,565 | 8/1976 | Muller | 221/33 |

*Primary Examiner*—William T. Dixson, Jr.

[57] ABSTRACT

A stack of cardmarkers for use by accountants and bookeepers when making entries in ledgers which are then tallied, and a dispenser pack from which the cardmarks are individually slided for use, each cardmark being a flat strip of polystyrene with holes near each end, and a notch along each side edge, engaged by a protrusion inside the pack, and the pack comprising a box that is open on one end and on top.

1 Claim, 5 Drawing Figures

10
17
19
BIG A ACCOUNTANTS' & BOOKKEEPERS'
50 CARDMARKS IN DISPENSER PACK
1. SAVES TIME — EASILY INSERTED AND REMOVED — NOT BULKY
2. INCREASE ACCURACY — NO MORE MISSED ENTRIES
3. SPEEDS TALLY — TURN PAGES TO NEXT "DOT" WITH ONE HAND
WON'T MAR LEDGER PAGES OR PULL OUT, ONCE INSERTED.
12
11

14

15
13

16
18
20
21

ACCOUNTANTS AND BOOKKEEPERS CARDMARKS IN DISPENSER PACK

It is well known to those persons acquainted with the particular fields of accounting, bookeeping and the like, that cardmarks, comprising usually index cards or pieces of oaktag, are used when making entries in accounts payable or receivable ledgers or a general ledger. The entries are tallied, but the cardmarks need to be wedged into the ledger page so that they do not fall out, otherwise a person will miss adding the entry into his tally. Then after the tally is proofed, the cardmarks are finally removed, sometimes damaging the page. At best, it is a time consuming process.

Accordingly, it is a principal object of the present invention, to provide cardmarks made of polystyrene and which are neatly dispensed from a dispenser pack, the cardmarks being easily inserted, and the pages being able to be turned either from a top or bottom of a ledger, leaving one hand free for adding the machine tally.

Another object is to provide a cardmark which can be easily removed because it is smooth so as to be easily slided.

Yet another object is to provide a cardmark having an opening therethrough near each end that makes a next entry easy to see, since it is unusual to be able to insert the cardmark at identical levels, the lower opening being for those who prefer turning ledger pages from a bottom, so as to increase a speed and an accuracy of a tally.

Yet a further object is to provide a dispenser pack for handling and storage of the cardmarks.

Figures 1, 2, 3, 4, 5:
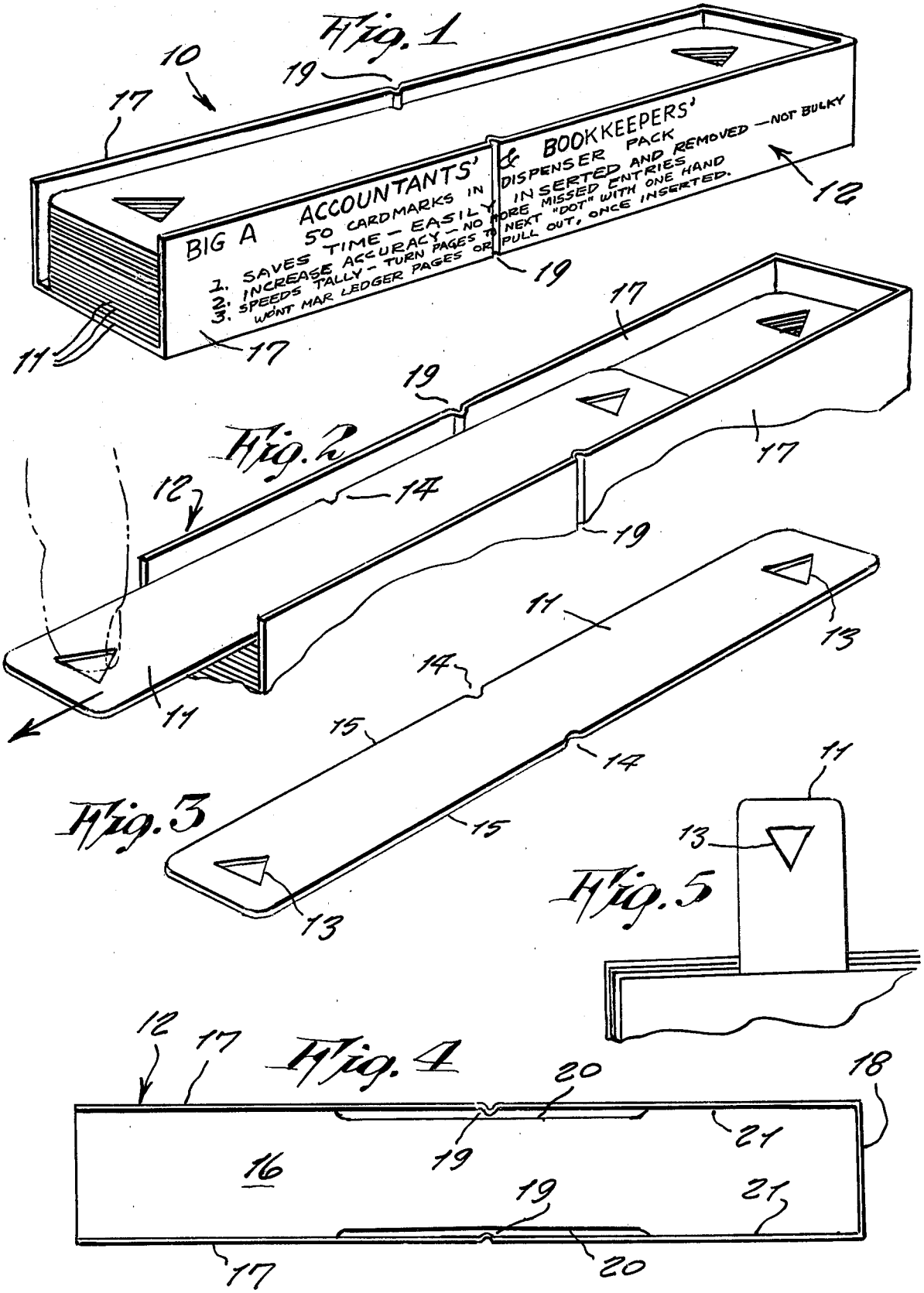
FIG. 1 is a perspective view of the dispenser pack loaded with cardmarks.
FIG. 2 is a fragmentary similar view showing a top cardmark being extracted from the pack.
FIG. 3 shows a removed cardmark.
FIG. 4 is a top view of the dispenser pack emptied of cardmarks, and showing one design wherein one side wall is indented so to buldge into a notch on one side on all the cardmarks, so to frictionally hold the stack of cardmarks rigidly in the pack while an uppermost one is slided out for dispensing, and thus eliminate a big bunch thereof slide out all at one time.
FIG. 5 shows a cardmark in use between papers of a file.

Referring now to the drawing in detail, the reference numeral 10 represents an assembly a-cording to the present invention with includes a plurality of cardmarks 11 fitted in a dispenser pack 12.

Each cardmark comprises an elongated flat strip made from a polystyrene material so to be smooth and slidable with minimum friction. A practical size thereof is approximately 12 by $1\frac{1}{4}$ inches. These dimensions would be different for those used with computer read out sheets. A triangular hole 13 near each end of the cardmark, extends therethrough, the apex of each hole pointing in a same longitudinal direction of the cardmark.

All corners of the cardmark are rounded, and a notch 14 is provided along a center of each long side dedge 15 thereof.

The dispenser pack comprises a rectangular box in including a bottom wall 16, opposite side walls 17, and one end wall 18, so that the box is open on top and at its other end. The box is of a size so that the cardmarks fit snuggly therein.

An inwardly protrusion 19 formed on each side wall 17 serves to fit inside the notches 14 of all the cardmarks that are stacked inside the box, so as to prevent the cardmarks to spill out therefrom and also prevent more than one to slide out when a top one thereof is being outwardly slided during a dispensing operation, as shown in FIG. 2. In order that the walls 17 flex outwardly an equal amount when dispensing either an uppermost, lowermost or any other cardmark, so that the protrusions move out the notches, a slit 20 is provided along a center of the junctioning edge 21 between each side wall and the bottom wall, as shown in FIG. 4.

What is claimed:

1. An article of manufacture for accountants, and bookkeepers, comprising in combination, an assembly of a plurality of cardmarks and a dispensing container of conforming shape for containing said cardmarks for dispensing, each said cardmark being elongated and flat having opposite side edges with notches engaged by opposite sides and inward protrusions on said opposite sides of said container said container comprising a box with an open top, including a bottom wall, said opposite side walls, an end wall and an open end wherein a triangular opening is provided near each opposite end of said cardmark wherein the apex of each triangular opening is along the cardmark longitudinal axis wherein said container includes means for causing outward flexing of said protrusions in response to longitudinal movement of the cardmarks to facilitate insertion and removal of the cardmarks, wherein said means comprises slits along each side of said bottom wall adjacent said protrusions whereby said protrusions are not attached to said bottom wall.

* * * * *